US007654014B1

(12) United States Patent
Moore et al.

(10) Patent No.: US 7,654,014 B1
(45) Date of Patent: Feb. 2, 2010

(54) GOLF SHOE

(75) Inventors: Brian L. Moore, 12923 Timber Ridge Dr., Fort Myers, FL (US) 33913; Brian M. Moore, Alpharetta, GA (US); Jonathan Holmes, Winston, GA (US)

(73) Assignee: Brian L. Moore, Fort Myers, FL (US)

( * ) Notice: Subject to any disclaimer, the term of this patent is extended or adjusted under 35 U.S.C. 154(b) by 0 days.

(21) Appl. No.: 12/329,663

(22) Filed: Dec. 8, 2008

(51) Int. Cl.
*A43B 5/00* (2006.01)

(52) U.S. Cl. ..... 36/127; 36/134

(58) Field of Classification Search ..... 36/15, 36/31, 36 R, 127, 134, 12, 135
See application file for complete search history.

(56) References Cited

U.S. PATENT DOCUMENTS

| | | | | | |
|---|---|---|---|---|---|
| 1,304,616 | A | | 5/1919 | Smith | |
| 1,998,921 | A | * | 4/1935 | Brown | 36/7.7 |
| 3,354,561 | A | * | 11/1967 | Cameron | 36/134 |
| 3,481,332 | A | * | 12/1969 | Arnold | 602/10 |
| 3,680,231 | A | | 8/1972 | Dymond et al. | |
| 3,707,047 | A | | 12/1972 | Nedwick | |
| 3,731,323 | A | * | 5/1973 | Glancy | 623/27 |
| 3,739,497 | A | | 6/1973 | Cameron | |
| 3,757,437 | A | * | 9/1973 | Cameron | 36/59 R |
| 3,816,945 | A | * | 6/1974 | Egtvedt | 36/114 |
| 5,243,776 | A | | 9/1993 | Zelinko | |
| 5,392,537 | A | | 2/1995 | Goldberg et al. | |
| 5,566,478 | A | | 10/1996 | Forrester | |
| 5,682,689 | A | * | 11/1997 | Walker et al. | 36/134 |
| 5,692,323 | A | | 12/1997 | Goldberg et al. | |
| 6,035,559 | A | * | 3/2000 | Freed et al. | 36/134 |
| 6,701,645 | B1 | * | 3/2004 | Forrester | 36/134 |
| 6,829,848 | B2 | * | 12/2004 | Gallegos | 36/103 |
| 2002/0088147 | A1 | | 7/2002 | Joo et al. | |
| 2006/0032092 | A1 | | 2/2006 | Drollinger et al. | |

OTHER PUBLICATIONS

United-Golfers, The Revolution in Golf—The Free Release Golf Shoe Instruction Manual; Obtained by Applicants—Jun. 2008, www.united-golfers.com (35 pages).

United-Golfers, Golf Biomechanics; The Free-Release Method: more distance increased precision simpler; Brochure; Obtained by Applicants—Jun. 2008; www.united-golfers.com; (16 pages).

United-Golfers, Stress-Transfer!; Brochure, Obtained by Applicants—Jun. 2008, www.united-golfers.com, (1 page).

* cited by examiner

*Primary Examiner*—Mickey Yu
*Assistant Examiner*—Sharon M Prange
(74) *Attorney, Agent, or Firm*—Rader Fishman & Grauer

(57) ABSTRACT

A golf shoe is disclosed that includes an upper shoe configured to be selectively secured to a foot. A sole assembly of the shoe includes articulating cleats that allow a user's front foot to pivot during a golf swing while maintaining the cleats in a generally fixed position with respect to the ground surface. Articulating cleats may be provided on a pivoting heel assembly that is disposed beneath a heel portion of the shoe. Articulating cleats may also be provided on a sliding forefoot support.

19 Claims, 6 Drawing Sheets

GOLF SHOE

BACKGROUND

Golf is a well known game in which players swing a club at a ball placed on a ground surface or tee in front of the player. Generally, a player's feet should remain stationary during their swing, especially when a player is attempting to drive the ball a great distance. Golf players thus typically use cleated shoes that provide traction by digging into the ground surface. Ground surfaces are generally varied on any given hole, providing the player with specific ideal positions from which striking the ball may be comparatively easy, such as a fairway or green having evenly cut, short grass, and other ground surfaces where it is much more difficult, such as a sand bunker or a rough having longer grass.

While a secure, stationary position is generally necessary to allow the player to drive the ball with power and accuracy, the twisting motion of the body during the golf swing puts a great deal of strain on the body. While a player may not immediately notice the strain from one particular swing, this strain may accumulate over the course of a golf round, which can last well over four hours for a round of eighteen holes. Further, frequent golfers are even more subject to stress injuries to the golfer's knee, back, or hip, merely as examples.

What is needed, therefore, is a golf shoe that provides secure footing for a player during the player's swing while also reducing bodily stress caused by the swing, while not significantly increasing the complexity of the shoe.

BRIEF DESCRIPTION OF THE DRAWINGS

Referring now to the drawings, exemplary illustrations are shown in detail. Although the drawings represent some examples, the drawings are not necessarily to scale and certain features may be exaggerated, removed, or partially sectioned to better illustrate and explain the present invention. Further, the exemplary illustrations set forth herein are not intended to be exhaustive or otherwise limit or restrict the claims to the precise forms and configurations shown in the drawings and disclosed in the following detailed description:

DETAILED DESCRIPTION

Various exemplary illustrations of a golf shoe are disclosed herein. An exemplary golf shoe may include an upper shoe configured to selectively secure a user's foot within the upper shoe. A sole assembly of the shoe includes articulating cleats that allow a user's front foot to pivot during a golf swing while maintaining the cleats in a generally fixed position with respect to the ground surface. Articulating cleats may be provided on a pivoting heel assembly that is disposed beneath a heel portion of the shoe. Articulating cleats may also be provided on a sliding forefoot support. The heel assembly may include a heel support that is selectively pivotable about a center of rotation between a first heel position and a second heel position. The sliding forefoot support may be slidable with respect to said upper shoe along an arc between a first forefoot position and a second forefoot position. The second forefoot position of the sliding forefoot support may be disposed laterally inward, i.e., closer to an opposite foot of the user, with respect to the second forefoot position. The heel support is initially in the first heel position, and the forefoot support is initially in the first forefoot position, when a user wears the foot on their forward foot when addressing a golf ball prior to initiating a swing with a golf club. The heel support may pivot from the first heel position to the second heel position, and the forefoot support may slide from the first forefoot position to the second forefoot position, during the user's forward swing, e.g., after a backswing, and as the user swings the club forward, striking the golf ball and following through.

Figure 1A:
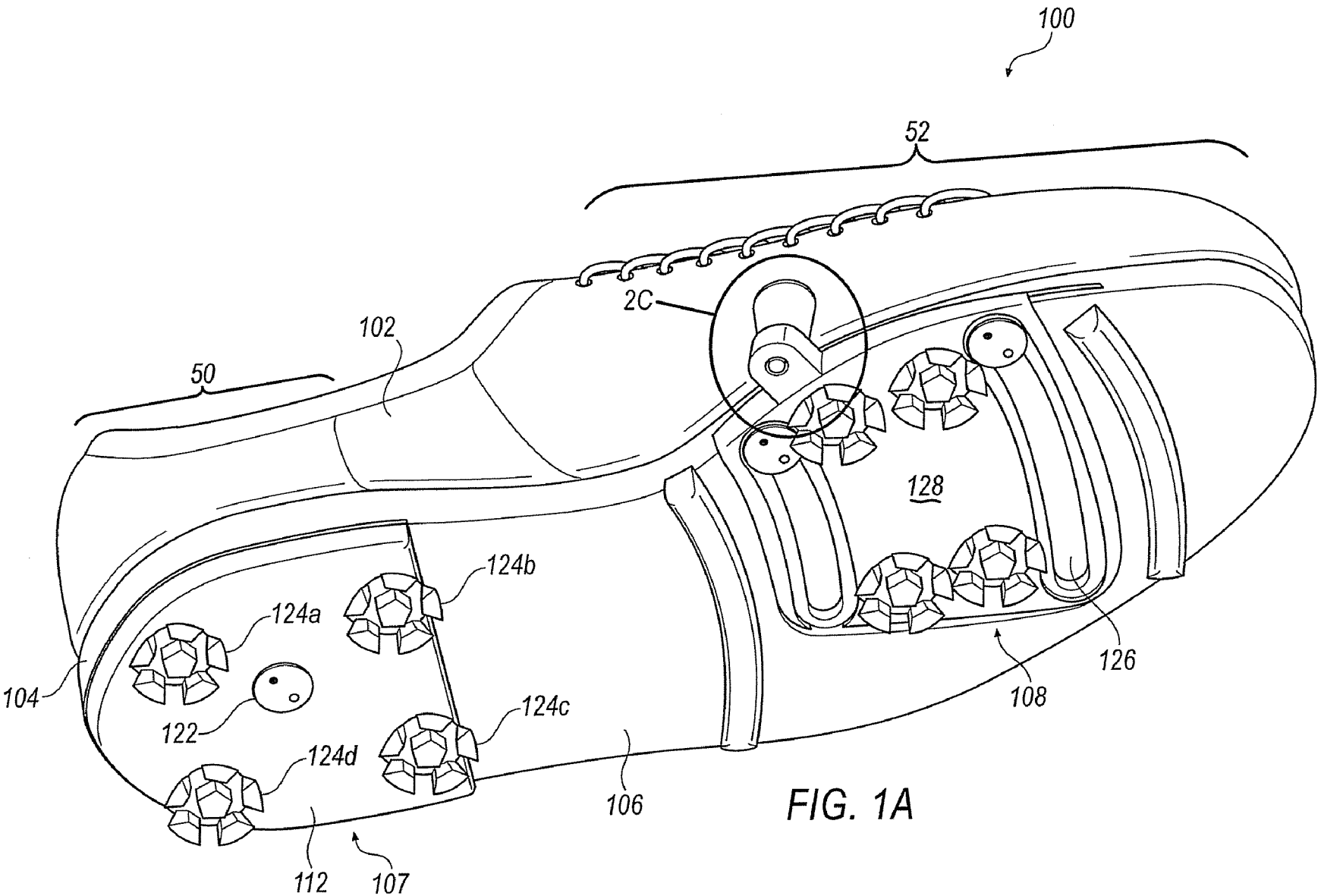
FIG. 1A is a bottom perspective view of an exemplary illustration of a golf shoe.
Figure 1B:
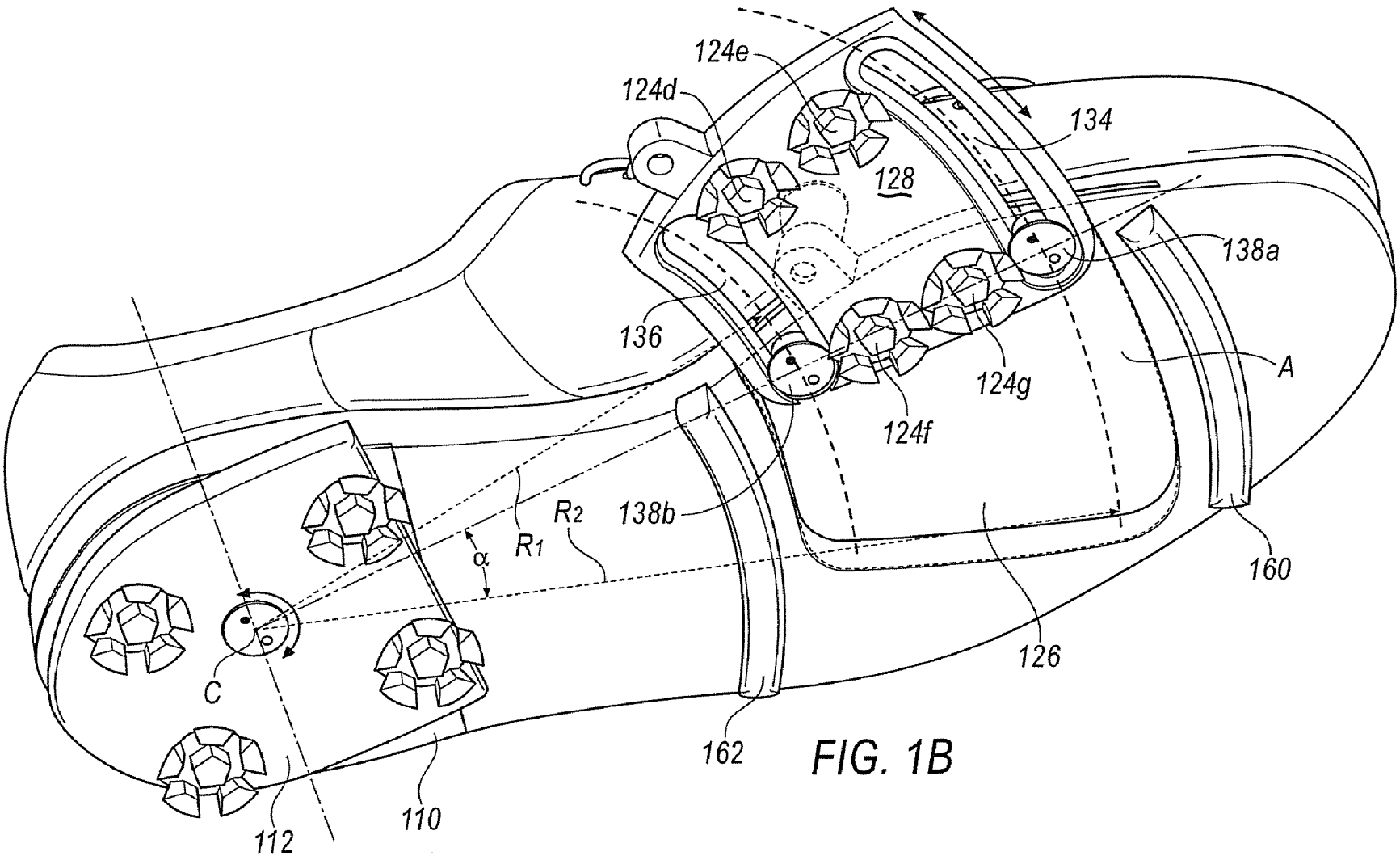
FIG. 1B is a bottom perspective view of a sole assembly of the golf shoe illustrated in FIG. 1A, with a heel cleat assembly and forefoot cleat assembly in articulated positions.

Turning now to FIGS. 1A and 1B, a golf shoe 100 is illustrated that includes an upper shoe 102 and sole assembly 104. Upper shoe 102 may include a heel portion 50 and a forefoot portion 52, and an insole side IS and an outsole side OS. The upper shoe 102 is generally configured to secure the foot of a user to the sole assembly 104 such that the user's heel is disposed in the heel portion 50 of the upper shoe 102, while the user's forefoot is disposed in the forefoot portion 52 of the upper shoe 102. Upper shoe 102 may include laces, velcro straps, and/or other adjustable fasteners that allow a user to secure the user's foot to the sole assembly 104. Shoe 100 is illustrated as a left foot design, and thus is generally suited for a right-handed golfer. However, the concepts described herein are universally applicable to a right foot shoe design as well, as further described below.

Sole assembly 104 generally includes main sole 106, heel cleat assembly 107 and forefoot cleat assembly 108. As shown in FIGS. 1A and 1B, main sole 106 may generally extend along an entire length of the upper shoe 102. Main sole 106 may be formed of any materials typical of shoe sole applications, and preferably has a stiffness sufficient to provide support for a user's foot, while also being flexible enough to allow bending of the feet, e.g., during walking. As an example, main sole 106 may be molded from an ethylene vinyl acetate (EVA) material. Main sole 106 may be secured to upper shoe 102 in any manner that is convenient. For example, main sole 106 may be secured to upper shoe 102 with mechanical fasteners such as nails or screws, or by an adhesive or bonding material. Main sole 106 generally provides a platform for heel cleat assembly 107 and forefoot cleat assembly 108.

The heel cleat assembly 107 generally engages a ground surface beneath heel portion 50 of upper shoe 102. As best seen in FIG. 1A, heel cleat assembly 107 may be generally centered beneath heel portion 50, i.e., where a user's heel will be located upon securing shoe 100 to the user's foot. The forefoot cleat assembly 108 generally engages a ground surface, thereby supporting forefoot portion 52 of upper shoe 102.

Each of the heel cleat assembly 107 and forefoot cleat assembly 108 are configured to pivot and/or slide to enable pivoting of a user's foot, such as during a golf swing. Furthermore, each of the heel cleat assembly 107 and forefoot cleat assembly 108 may generally be maintained securely against a ground surface while the user's foot pivots. Accordingly, the user's foot generally remains secure in upper shoe 102 and can rotate with respect to the heel cleat assembly 107 and forefoot cleat assembly 108, while heel cleat assembly 107 and forefoot cleat assembly 108 each remain stationary with respect to the ground surface.

Figure 3A:
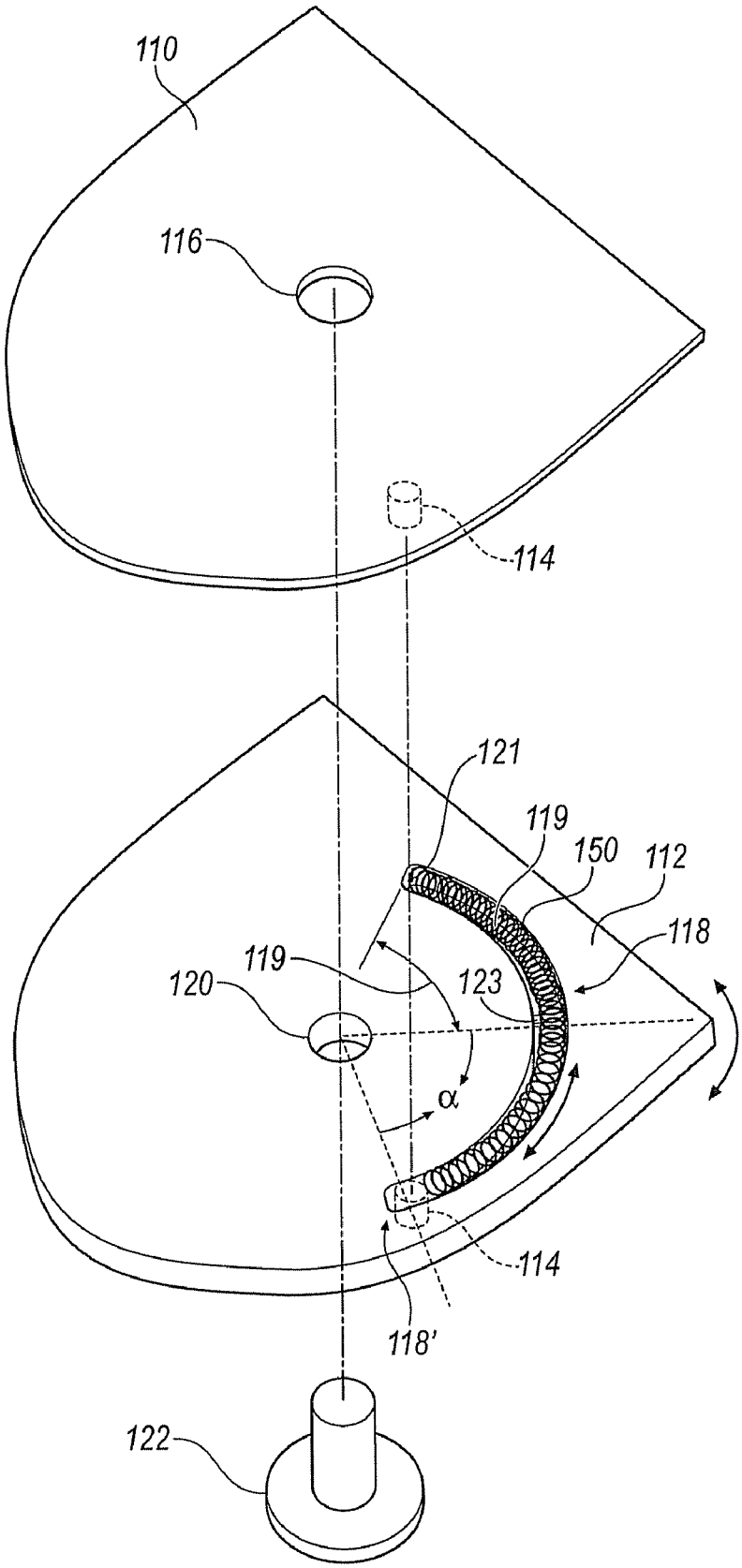
FIG. 3A is an exploded view of a heel cleat assembly of the golf shoe shown in FIGS. 1A and 1B.
Figure 3B:
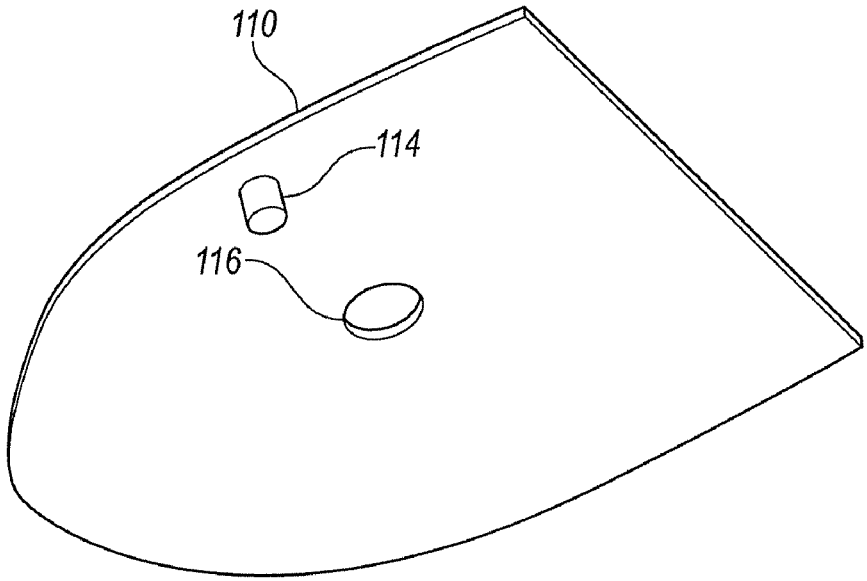
FIG. 3B is a bottom perspective view of the heel plate shown in FIG. 3A.
Figure 3C:
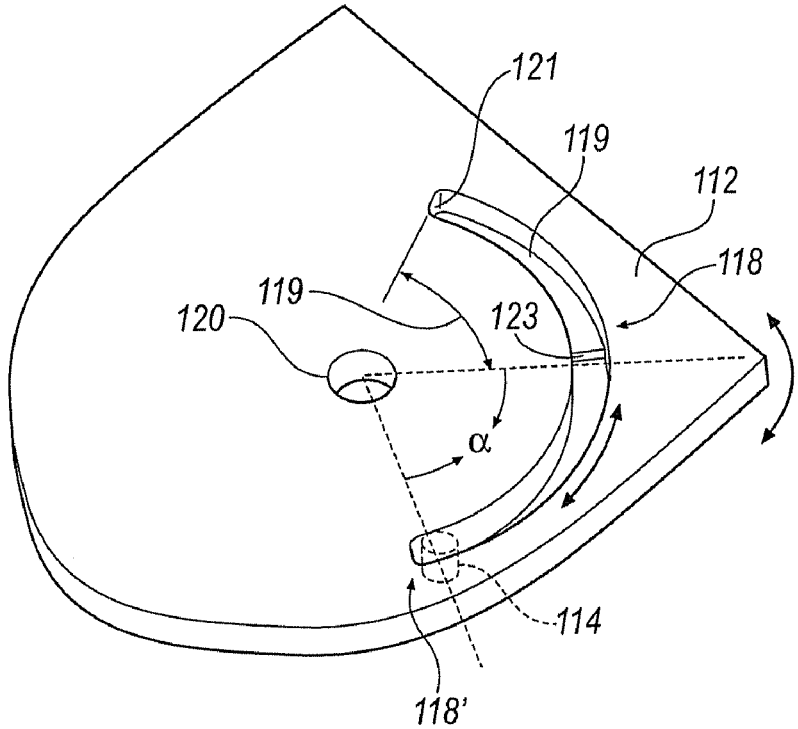
FIG. 3C is a top perspective view of the heel support shown in FIG. 3A.

Heel cleat assembly 107 generally includes a heel plate 110 and a heel support 112, as best seen in FIGS. 3A, 3B, and 3C. Heel plate 110 may be formed of any material that is convenient. For example, heel plate 110 may be formed of a stainless steel material that is approximately 0.06 inches thick. The heel plate 110 is secured to main sole 106 by any method that is convenient, e.g., mechanical fasteners, bonding, adhesives, or the like. Alternatively, heel plate 110 may be molded within main sole 106. In other words, main sole 106 may be formed in a molding operation such that the main sole retains heel plate 110 to the main sole 106.

Heel support 112 is secured to heel plate 110 such that heel support 112 is rotatable with respect to the heel plate 110. For example, as shown in the figures, heel support 112 includes a support aperture 120. Support aperture 120 generally aligns with a plate aperture 116 defined by the heel plate 110, as best seen in FIG. 3A. Accordingly, a single heel fastener 122 may be used to secure the heel support 112 to the heel plate 110 and/or the main sole 106. The support aperture 120 may be sized relative to the fastener 122 to allow the heel support 112 to generally freely pivot about the heel fastener 122. Heel fastener 122 may be a press-fit fastener, threaded fastener, or any other fastener that is convenient. Heel fastener 122 is preferably selectively removable from the heel plate 110 and/or main sole 106, such that the fastener 122, and thus the heel support 112, may be easily removed for service or replacement without damaging or otherwise necessitating further service to the heel support 112, or perhaps any other part of the shoe 100. The heel support 112 may thus be selectively removed and reinstalled to the heel plate 110 and/or main sole 106 with a same fastener 122. Accordingly, no part of the shoe 100 need be replaced in order to remove and/or reinstall the heel support 112 from/to the shoe 100. In one example, the heel fastener 122 is press-fit into the plate aperture 116, thereby securing the heel fastener 122 to the heel plate 110 and allowing rotation of the heel support 112 with respect to the heel plate 110. As best seen in FIGS. 1B and 3A, heel support 112 pivots about a center of rotation C generally defined by the alignment of the plate aperture 116, support aperture 120, and/or fastener 122.

Turning now to FIGS. 3A and 3C, the heel support 112 may define an arcuate guide slot 118 that receives a guide pin 114 of the heel plate 110. The arcuate guide slot 118 generally receives guide pin 114 of heel plate 110 and allows for selective movement of guide pin 114 along the arcuate guide slot 118 when the heel support 112 is rotated with respect to the main sole 106. Additionally, pin stops may be provided within the guide slot 118 that define a maximum rotation of the heel support 112 by abutting or engaging the guide pin 114. For example, as best seen in FIG. 3C, guide pin 114 may selectively travel between a first end 118' of arcuate guide slot 118 and a pin stop 123 provided within the guide slot 118. The guide pin 114, as shown in FIG. 3A, may be generally disposed at the first end 118' of the guide slot 118 when the heel support 112 is aligned beneath the main sole 106 for walking. As the user pivots their foot when swinging a golf club, the guide pin 114 slides along the guide slot 118 until it abuts the pin stop 123. Accordingly, arcuate guide slot 118 generally defines a maximum angle of rotation a about center of rotation C for heel support 112. As best seen in FIG. 3A, angle $\alpha$ may be approximately 23 degrees. The arcuate guide slot 118 may be configured to allow any angle $\alpha$ that is convenient. The shoe 100 illustrated is configured as a United States men's size 11 shoe, and the angle may be scaled for other shoe sizes where convenient. Generally, a greater angle may be desirable for larger shoe sizes, while smaller angles may be convenient for smaller shoe sizes, as the maximum angle may be limited by the amount of sideways excursion of the forefoot portion 52 as the user pivots their foot about center of rotation C, as further described below. However, any angle $\alpha$ that is convenient may be employed.

The shoe 100 may include a mechanism that generally maintains the heel support 112 in a walking position, while also allowing selective rotation of the heel support 112 with respect to the main sole 106 when a user pivots their foot, e.g., when swinging a golf club, while wearing the shoe 100. For example, heel support 112 may further include an elastic or spring element to bias the travel of heel support 112 in a desired direction. As best seen in FIG. 3A, a compression spring 150 may be provided within a subcavity 119 of arcuate guide slot 118, such that the compression spring engages guide pin 114. The compression spring 150 thus is compressed as heel portion 112 is rotated about center of rotation C and away from a first position, e.g., as shown in FIG. 1A, toward a second position, e.g., as shown in FIG. 1B. In other words, as the heel support 112 pivots, guide pin 114 travels along the guide slot 118 from the first end 118' toward the opposite end, thereby compressing the compression spring 150. The compression spring 150 provides an increasing spring force as the heel support 112 is pivoted that tends to bias the heel portion 112 back to its original position, i.e., where it is generally centered beneath heel portion 50 of upper shoe 102 for walking. In other words, as heel support 112 is pivoted further away from the first position, i.e., in FIG. 1A, the compression spring is compressed between a generally vertical surface 121 within subcavity 119 and the guide pin 114 of the heel plate 110. The compression force provided by the spring may also generally prevent unintended rotation of the heel support 112, e.g., when the user is walking. Accordingly, the compression spring 150 may generally prevent the heel support 112 from rotating with respect to the main sole 106 except when the user is actively pivoting their foot, e.g., when swinging a golf club, thereby stabilizing the shoe 100 for the user when the user is walking. The biasing force of the compression spring 150 is thus useful both for returning the heel support 112 after the completion of a golf swing, as well as preventing unintended pivoting of the heel support 112 with respect to the main sole 106 when it is not desired. While shoe 100 has been described with a compression spring 150 that biases the heel support 112, other types of elastic elements or other mechanisms may be provided that bias the heel support 112 into a desired position. Further, elastic elements or springs need not be disposed within the arcuate guide slot 118 illustrated herein. For example, a torsional spring may be provided within heel support 112. Further, a torsional spring (not shown) may be formed integrally with the heel support 112.

A variety of elastic elements or springs may be provided with shoe 100 in order to allow a user to select a spring force to meet their particular preference. For example, a plurality of elastic elements or compression springs 150 that are selectively installable to the shoe 100, each having a different compression rate, may be provided. A user may thus select a spring having a relatively low compression rate when the user desires a minimum amount of resistance to the shoe pivot during the golf swing. Conversely, if a user desires a greater level of resistance to the shoe pivoting, a spring having a greater compression rate may be selected. Further, where the heel fastener 122 is easily removable from the shoe 100, e.g., the fastener 122 is threaded or press-fit such that is may be removed and replaced without damaging any part of the shoe 100 or the fastener 122, the user may easily remove the heel support 112 from the shoe 100 and replace the compression spring 150 with another spring when desired, e.g., when the spring 150 is damaged or the user desires a spring with a different resistance or compression rate. Shoe 100 may thus be customized according to the preferences of the user.

Heel support 112 may be provided with a sealed ball bearing (not shown) to promote smooth rotation of heel support 112 about heel fastener 122 and with respect to the heel plate 110. In other words, ball bearings may be provided within a cavity of heel support 112 such that the ball bearings engage heel fastener 122 and/or heel plate 110, thereby reducing resistance of heel support 112 to rotation about the heel fastener 122.

Heel support 112 further includes at least one cleat 124 for engaging a ground surface. For example, as shown in FIGS. 1A and 1B, heel support 112 includes four cleats 124*a*, 124*b*, 124*c*, and 124*d*. The cleats 124 generally maintain heel support 112 in position with respect to a ground surface, while the user's foot and/or upper shoe 102 is allowed to pivot about center of rotation C.

Heel cleat assembly 107 thus generally rotates or pivots selectively according to passive activation by a user wearing shoe 100. In other words, as a user stands upon a ground surface wearing shoe 100, the user may pivot the foot secured to shoe 100 about center of rotation C, such as during a forward swing with a golf club. As shown in FIGS. 1A and 1B, heel cleat assembly 107 generally rotates about a center of rotation C that is defined by plate aperture 116 and/or support aperture 120 and/or heel fastener 122. In other words, a center of each of the plate aperture 116, support aperture 120, and heel fastener 122 may be co-located to define the center of rotation C for the main sole 106, upper shoe 102, and the user's foot. Heel cleat assembly 107 thus rotates about center of rotation C with respect to the upper shoe 102 in response to passive activation by a user wearing shoe 100, e.g., when swinging a golf club.

Figure 4:
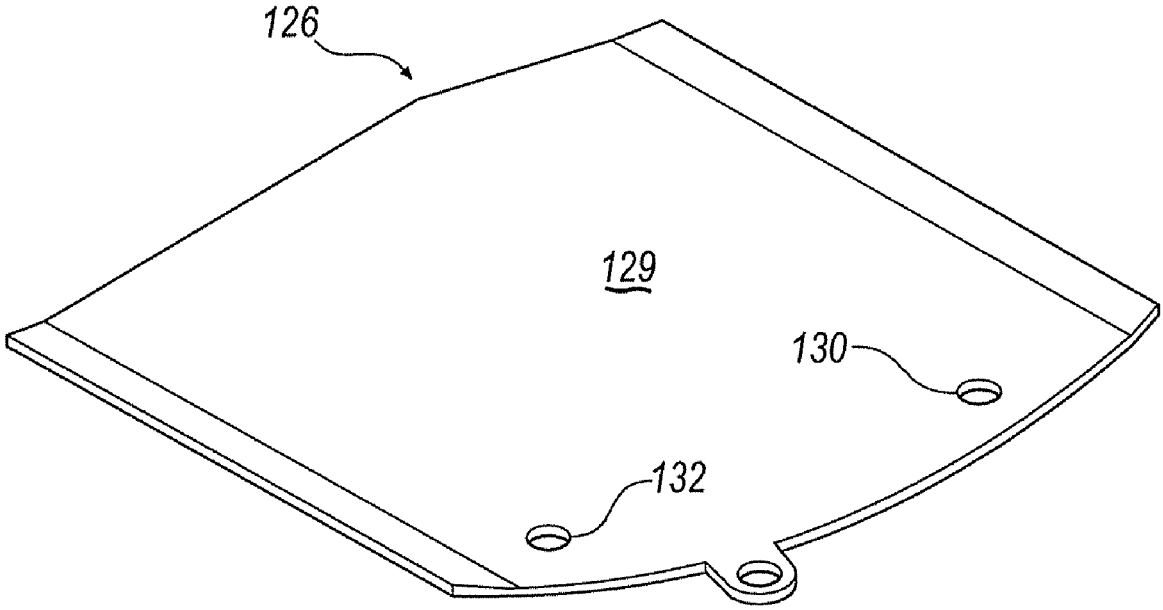
FIG. 4 is a top perspective view of a forefoot plate of the golf shoe shown in FIGS. 1A and 1B.

Turning now to FIGS. 1A, 1B, and 4, forefoot cleat assembly 108 will be described in further detail. Forefoot cleat assembly 108 may generally include a forefoot plate 126 and forefoot support 128. Forefoot plate 126 may be formed of any material that is convenient. In one example, forefoot plate is formed of a stamped stainless steel material that is approximately 0.06 inches thick. Forefoot plate 126 may be secured to main sole 106 in any manner that is convenient, such as mechanical fasteners, adhesives, bonding, or the like. Additionally, forefoot plate 126 may be integrally formed within main sole 106, as also described above in regard to heel plate 110. Further, main sole 106 may be molded about each of heel plate 110 and forefoot plate 126, such that the heel plate 110 and forefoot plate 126 are each retained within main sole 106. Forefoot support 128 may be similarly formed of any material that is convenient. In one known example, forefoot support 128 is formed of an ultra high molecular weight (UHMW) polyethylene material that is approximately 0.25 inches thick vertically.

Generally, forefoot support 128 is secured to forefoot plate 126 so that the forefoot support 128 can slide along forefoot plate 126. The forefoot support 128 may generally slide between a first forefoot position, illustrated in FIG. 1A, and a second forefoot position, illustrated in FIG. 1B, when a user swings a golf club. The forefoot support 128 is in the first forefoot position when the forefoot support 128 is in the nominal position, generally aligned with the upper shoe 102 as a traditional fixed-cleat shoe. The forefoot support 128 slides to a second forefoot position that is laterally inward with respect to the first forefoot position, e.g. in a direction generally toward an opposite shoe (not shown) worn by the user. Accordingly, when a right-handed golfer wears shoe 100 on their forward foot, i.e., their left foot, the forefoot of the left foot is allowed to shift in the direction in which the golf ball is struck as the golfer strikes the ball and follows through with the golf club. In other words, the forefoot portion 52 of upper shoe 102 moves laterally outward with respect to the instep side IS of the upper shoe 102 as the forefoot plate 128 slides from the first forefoot position to the second forefoot position.

As best seen in FIGS. 1A and 1B, forefoot support 128 may slide along forefoot plate 126 in an arc, such that it rotates about a same center of rotation as heel cleat assembly 107, e.g., center of rotation C. Accordingly, the upper shoe 102 may freely pivot about center of rotation C while each of the forefoot cleat assembly 108 and heel cleat assembly 107 remain engaged with the ground surface.

Forefoot plate 126 may include a forefoot bearing surface 129, a forward locating aperture 130 and a rearward locating aperture 132, as best illustrated in FIG. 4. The bearing surface 129, best seen in FIG. 4, generally abuts the main sole 106 such that the main sole 106 bears down upon the bearing surface 129 when a user applies weight to the shoe 100. Forefoot support 128 generally includes a forward slot 134 and a rearward slot 136, as best illustrated in FIG. 1B. A pair of forefoot support fasteners 138*a* and 138*b* may be inserted through slots 134, 136 and secured to apertures 130, 132 of forefoot plate 126, respectively. Accordingly, forefoot support 128 is generally allowed to selectively slide in and out of a cavity A defined by main sole 106. The sliding of forefoot plate 126 is generally defined by movement of slots 134, 136 with respect to the fasteners 138*a*, 138*b*, respectively, which remain secured in place relative to the upper shoe 102 and main sole 106. As best seen in FIG. 1B, rearward slot 136 arcs along a radius $R_1$, while forward slot 134 arcs along a radius $R_2$. In the example illustrated, where shoe 100 is a United States men's size 11 shoe, R1 may be approximately 5 inches, while R2 is approximately 8.5 inches. Any other dimension that is convenient may be employed. Preferably, the radii $R_1$ and $R_2$ defined by arcuate slots 134, 136 each generally extend from center of rotation C, such that sliding of forefoot support 128 is along an arc that is generally concentric with respect to the center of rotation C of the heel support 112. In any case, the forefoot support 128 should slide along an arc having a center of rotation that is at least close enough to the center of rotation of the heel support 112 so as to allow each of the heel cleat assembly 107 and the forefoot cleat assembly 108 to rotate and slide, respectively, simultaneously when a user pivots their foot.

Forefoot cleat assembly 108 also includes at least one cleat 124 for engaging a ground surface. For example, as best seen in FIGS. 1A and 1B, forefoot cleat assembly 108 generally includes four cleats 124*d*, 124*e*, 124*f*, and 124*g*. Any number of cleats 124 may be employed for heel cleat assembly 107 and forefoot cleat assembly 108.

Forefoot cleat assembly 108, as described above, generally slides along an arc having a center that generally coincides with the center of rotation C for heel cleat assembly 107, as best seen in FIG. 1B. Further, the maximum arc allowed by the forefoot cleat assembly 108 may have an angle approximately equal to that of the heel support 112. For example, the arcuate slots 134, 136 shown in FIG. 1B generally have an angle $\alpha$ of 23 degrees, which is equal to the maximum angle of rotation allowed by heel cleat assembly 107. When a user of shoe 100 secures the cleat elements 124 of forefoot cleat assembly 108 and heel cleat assembly 107 to a ground surface, e.g., when the user swings a golf club, upper shoe 102 may generally pivot about center of rotation C as the user follows through after making contact with the golf ball. Furthermore, because the center of rotation C defines the center of rotation for both the forefoot cleat assembly 108 and the heel cleat assembly 107, rotation of the shoe 100 about center of rotation C may generally freely occur. In other words, while the forefoot cleat assembly 108 and heel cleat assembly 107 generally support the forefoot and heel portions of the upper shoe 102, respectively, and the sliding mechanism and pivoting mechanism of each articulate independently of the other, they also generally cooperate to provide a single pivot point for upper shoe 102. Further, the center of rotation C of upper shoe 102 (and by extension, main sole 106) is located beneath heel portion 50 of upper shoe 102. Preferably, center of rotation C is beneath the heel portion 50 of upper shoe 102, and may even be generally centered beneath the user's heel. In other words, an axis of rotation including center of rotation C may be located generally where a user's heel will be placed in upper shoe 102 during use. However, the center of rotation C may be located anywhere else within the heel cleat assembly 107 that is convenient, and need not be centered directly or exactly beneath the user's heel.

Each of the forefoot cleat assembly 108 and heel cleat assembly 107 may be provided independently, i.e., no portion of the forefoot cleat assembly 108 and heel cleat assembly 107 are joined together or contacting, as best seen in FIGS. 1A and 1B. Further, the pivoting mechanism of the heel cleat assembly 107 and the forefoot cleat assembly 108 work independently of one another. Thus, each of the heel cleat assembly 107 and the forefoot cleat assembly 108 may be pivoted or slid, respectively, independent of any movement of the other. Further, while the forefoot cleat assembly 108 and heel cleat assembly 107 are generally simultaneously activated when a user plants shoe 100 upon a ground surface and pivots their foot, thereby allowing the user's foot to freely pivot about center of rotation C, each of the forefoot cleat assembly 108 and heel cleat assembly 107 allow for relatively small and lightweight cleat assemblies that may be assembled, serviced, and or removed from main sole 106 and/or upper shoe 102 independently of one another.

As best seen in FIG. 1B, main sole 106 may be provided with a pair of lateral slide supports 160, 162. Lateral slide supports may have an arcuate shape, and generally extend away from a bottom surface of main sole 106. Thus, when a user pivots their foot about center of rotation C and forefoot portion 52 of upper shoe 102 slides away from forefoot cleat assembly 108, lateral slide supports 160, 162 generally slide along the ground surface and prevent main sole 106 from any significant movement downward toward the ground surface. The slide supports 160, 162 thus stabilize the user's foot in a vertical direction, such that the user's foot pivots generally only laterally in rotation about center of rotation C. A first lateral slide support 160 may be located generally in front of the forefoot cleat assembly 108, while a second lateral slide support 162 is located generally behind the forefoot cleat assembly 108. The lateral slide supports 160, 162 are preferably relatively smooth, such that they may generally easily slide along a ground surface, e.g., a grass surface, as forefoot portion 52 of upper shoe 102 is moved away from, and then back towards, forefoot cleat assembly 108. Further, the arcuate shape of the slide supports 160, 162 may have a generally same center as that of the arcuate slots 134, 136 of the forefoot support 128, e.g., center of rotation C, to minimize any frictional resistance of the slide supports 160, 162 against the ground surface. In other words, if the center of the arcuate shapes defined by the arcuate slide supports 160, 162 each have a center that is generally the same as the center of rotation of the heel support 112 and/or the forefoot support 128, the slide supports 160, 162 will generally track along the ground surface in an arc shaped similarly as the slide supports 160, 162 themselves, thereby reducing frictional resistance with the ground surface. Lateral slide supports may be formed of any material that is convenient. In one example, lateral slide supports 160, 162 are formed of a stainless steel material.

Figure 2B:
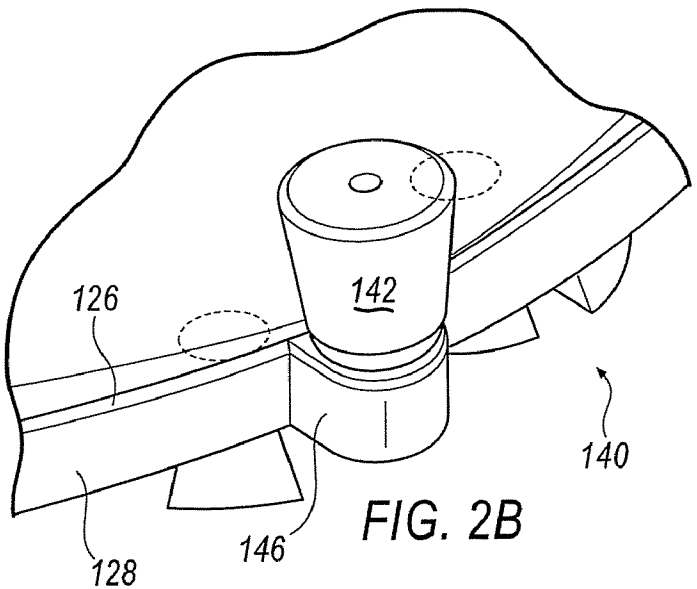
FIG. 2B is a closeup perspective view of a locking pin assembly.
Figure 2A:
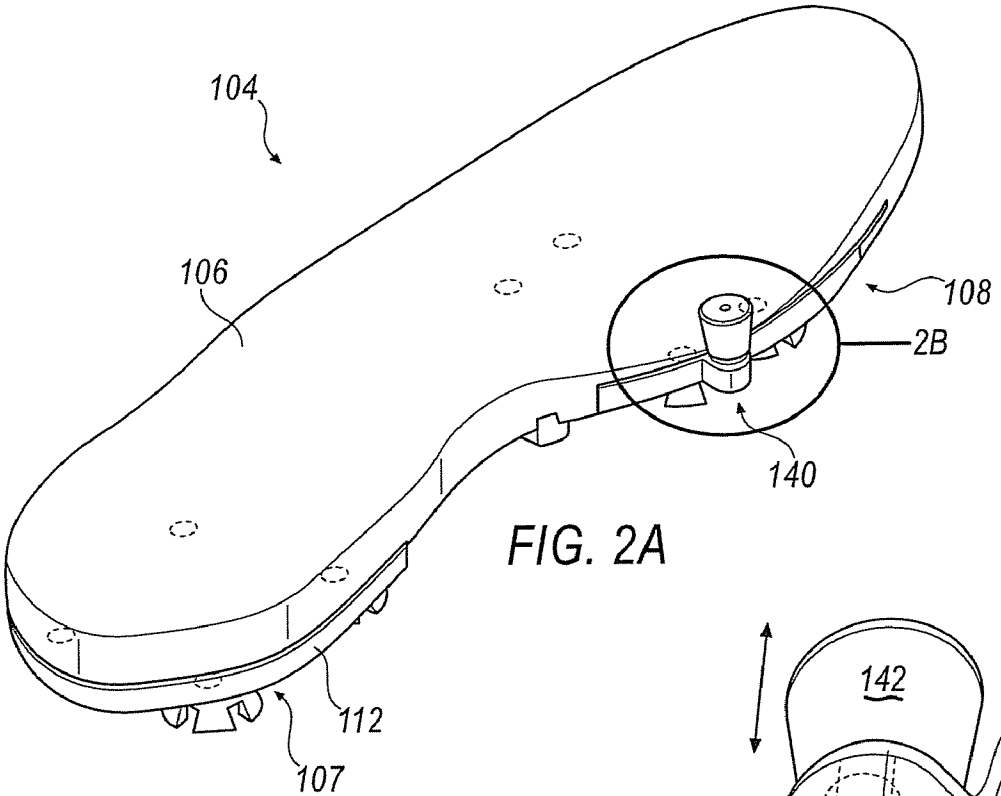
FIG. 2A is a top perspective view of the sole assembly shown in FIG. 1B.
Figure 2C:
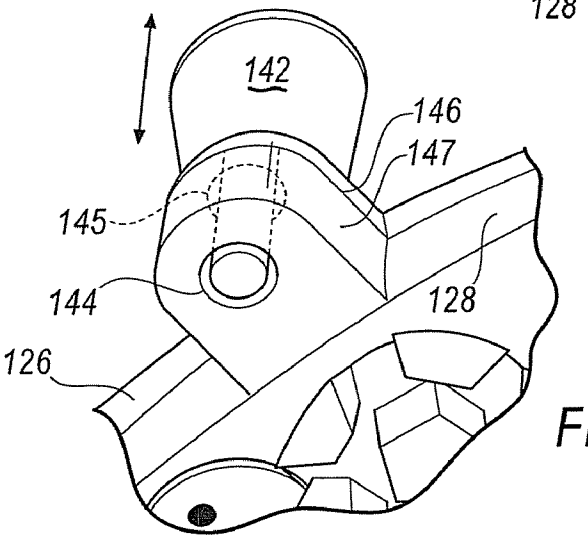
FIG. 2C is a closeup bottom perspective view of the locking pin assembly shown in FIG. 2B.

The forefoot cleat assembly 108 may include a mechanism or device for preventing unintentional sliding of the forefoot cleat assembly 108 with respect to the upper shoe 102 and/or main sole 106. For example, as shown in FIGS. 2A, 2B, and 2C, forefoot cleat assembly 108 may have a locking pin assembly 140. Locking pin assembly 140 may generally be disposed on an extension 146 of forefoot plate 126 that generally extends beyond a perimeter of main sole 106, as best seen in FIG. 2A. Similarly, forefoot support 128 may include a support extension 147 that is generally aligned beneath plate extension 146. Locking pin assembly 140 may include a locking pin 142 that selectively engages a plate locking aperture 145 that is provided in forefoot plate 126 and a support locking aperture 144 provided in forefoot support 128. Locking pin 142 thus selectively prevents movement of forefoot support 128, i.e., lateral sliding of forefoot support 128 as described above, while not interfering or contacting upper shoe 102, e.g., forefoot portion 52. Locking pin 142 may be moveably secured on a top side of forefoot plate 126, generally directly over support locking aperture 144. Locking pin 142 selectively extends into plate locking aperture 145, and further into support locking aperture 144 of forefoot support 128, thereby securing forefoot support 128 in its nominal position within cavity A. Accordingly, a user may selectively lock the forefoot support 128 in the first forefoot position, such as when a user is walking. When a user desires to use the pivoting feature of shoe 100, e.g., when swinging a golf club, the user may pull locking pin 142 upwards away from the ground surface such that it no longer extends into support locking aperture 144, thereby freeing forefoot support 128 for selective sliding in and out of cavity A, i.e., between the first and second forefoot positions. Other mechanisms, e.g., a detent mechanism, may be utilized for selectively locking the forefoot plate 126 in place to prevent sliding.

Generally, a user may wear the shoe 100 on their forward foot when golfing. Accordingly, a right-handed golfer would wear the shoe 100, which is illustrated as a left-foot version, on their left foot. Conversely, a left-handed golfer would wear a right-foot version of shoe 100 on their right foot. The user may wear a traditional fixed-cleat version of the shoe 100 on the opposite foot. Further, each shoe is preferably approximately the same weight, such that the feel of the shoes is not markedly different from traditional fixed-cleat shoes when the user is not actively pivoting the shoe, i.e., anytime the user is not swinging a golf club. It may thus be desirable to weight the traditional fixed-cleat shoe worn by the user to balance out any extra weight that may result from the sliding forefoot cleat assembly 108 and the pivoting heel cleat assembly 107.

When not swinging a golf club, the user may leave the forefoot cleat assembly 108 locked in place, e.g., via locking pin 142 as described above. Further, a biasing force provided by compression spring 150 may generally maintain heel cleat assembly 107 in a position where it is aligned beneath the main sole 106. Accordingly, the shoe 100 generally may function as any traditional fixed-cleat design when the user does not wish to pivot the shoe 100, e.g., when walking, hitting a golf ball from a hazard area such as a bunker or sand trap, etc.

When the user desires to pivot their foot, e.g., when swinging a golf club, the user may unlock the forefoot cleat assembly 108, e.g., by disengaging the locking pin 142. As the user initiates the backswing, the shoe 100 generally maintains the upper shoe 102 in position relative to the ground surface. As the user swings the golf club downward and contacts a golf ball with the club, the shoe 100 allows the forward foot of the user to pivot (i.e., the forward foot of a right-handed golfer rotates counter-clockwise, while the forward foot of a left-handed golfer would rotate in a clockwise direction) about the center of rotation of the shoe 100, e.g., center of rotation C. Accordingly, as the user swings through the ball and transfers their weight to the forward foot, the forward foot is allowed to pivot in a direction that coincides with the user's momentum, thereby reducing stress in the user's knee, hip, back, etc., that would otherwise result from the twisting or "uncoiling" motion associated with swinging a golf club.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A golf shoe, comprising:

an upper shoe configured to be selectively secured to a foot, said upper shoe including a heel portion configured to receive a heel of the foot, and a forefoot portion configured to receive a forefoot portion of the foot;

a main sole secured to said upper shoe and extending from said forefoot portion to said heel portion;

a heel plate secured to said main sole, said heel plate disposed beneath said heel portion of said upper shoe, said heel plate defining a center of rotation and a guide pin, said center of rotation disposed beneath said heel portion of said upper shoe;

a heel support pivotally secured to said heel plate and defining an arcuate guide slot that receives said guide pin, said heel support selectively pivotable about said center of rotation between a first heel position and a second heel position, said heel support including at least one heel cleat for engaging a ground surface;

a spring element received in said arcuate guide slot, a first end of said spring element abutting a surface of said arcuate guide slot, a second end of said spring element abutting said guide pin, said spring element biasing said heel support away from said second heel position and toward said first heel position;

a forefoot plate secured to said main sole adjacent a forefoot portion of said upper shoe; and a forefoot support defining at least two arcuate slots, each arcuate slot receiving a forefoot fastener for slidably securing said forefoot support to said main sole, each of said forefoot fasteners extending through one of said arcuate slots and being secured to said forefoot plate, each arcuate slot defining an arc having a center, said forefoot support selectively slidable with respect to said upper shoe along said arcs between a first forefoot position and a second forefoot position, said second forefoot position being disposed laterally inward with respect to said first forefoot position, said forefoot support including at least one forefoot cleat for engaging the ground surface;

wherein said heel support pivots from said first heel position to said second heel position, and said forefoot support slides from said first forefoot position to said second forefoot position, when said heel cleat and said forefoot cleat are engaged with the ground surface and said upper shoe is pivoted with respect to the ground surface such that said forefoot portion of said upper shoe moves laterally outward with respect to an instep side of said upper shoe.

2. The golf shoe of claim 1, further comprising:

a locking pin; and wherein said forefoot plate defines a locking aperture, and said forefoot support defines a retention aperture, said locking pin configured to selectively extend through said locking aperture and said retention aperture when said locking pin is in a locked position such that said forefoot support is maintained in said first forefoot position.

3. The golf shoe of claim 2, wherein said locking pin is selectively removable from said retention aperture, thereby allowing selective sliding of said forefoot support with respect to said upper shoe.

4. The golf shoe of claim 1, further comprising a pair of arcuate slide supports secured to said main sole and disposed beneath said forefoot portion of said upper shoe, said slide supports extending away from said main sole, said slide supports configured to slide laterally with respect to the ground surface when said forefoot and heel cleats are engaged with the ground surface and said upper shoe is pivoted about said center of rotation such that said forefoot support slides from said first forefoot position to said second forefoot position, said slide supports remaining stationary with respect to said upper shoe and supporting said forefoot portion of said upper shoe when said forefoot portion of said upper shoe is displaced laterally from said forefoot support.

5. The golf shoe of claim 1, wherein said arc defined by said arcuate slots of said forefoot support has a first angle, and said arcuate guide slot of said heel support allows pivoting of said heel support along a second angle, said first and second angles being approximately equal.

6. The golf shoe of claim 1, wherein said center of each of said arcs are generally coincident with said center of rotation of said heel support, such that said heel support and said forefoot support may selectively pivot and slide, respectively, generally simultaneously when said heel cleat and said forefoot cleat are engaged with the ground surface and said upper shoe is pivoted with respect to the ground surface.

7. The golf shoe of claim 1, wherein said selective sliding of forefoot support and said selective pivoting of said heel support are independent of each other.

8. The golf shoe of claim 1, wherein said forefoot plate defines two plate apertures, said plate apertures receiving said forefoot fasteners.

9. The golf shoe of claim 1, further comprising a heel fastener securing said heel support to said heel plate, said heel fastener being selectively removable, thereby allowing selective removal of said heel support from said heel plate and reassembly of said heel support to said heel plate with said heel fastener.

10. A sole assembly for a golf shoe, comprising:

a main sole configured to be secured to a bottom of an upper shoe, the upper shoe configured to secure a user's foot, said main sole including a forefoot portion configured to support a forefoot portion of the user's foot, said main sole including a heel portion configured to support a heel portion of the user's foot;

a heel plate secured to said main sole, said heel plate disposed beneath said heel portion of said main sole, said heel plate defining a center of rotation and a guide pin, said center of rotation disposed beneath said heel portion of said upper shoe;

a heel support pivotally secured to said heel plate and defining an arcuate guide slot that receives said guide pin, said heel support selectively pivotable about said center of rotation between a first heel position and a second heel position, said heel support including at least one heel cleat for engaging a ground surface;

a spring element received in said arcuate guide slot, a first end of said spring element abutting a surface of said arcuate guide slot, a second end of said spring element abutting said guide pin, said spring element biasing said heel support away from said second heel position and toward said first heel position;

a forefoot plate secured to said main sole adjacent said forefoot portion of said main sole; and a forefoot support defining at least two arcuate slots, each arcuate slot receiving a forefoot fastener for slidably securing said forefoot support to said main sole, each of said forefoot fasteners extending through one of said arcuate slots and being secured to said forefoot plate, each arcuate slot defining an arc having a center, said forefoot support selectively slidable with respect to said upper shoe along said arcs between a first forefoot position and a second forefoot position, said second forefoot position being disposed laterally inward with respect to said first forefoot position, said forefoot support including at least one forefoot cleat for engaging the ground surface;

wherein said heel support pivots from said first heel position to said second heel position, and said forefoot support slides from said first forefoot position to said second forefoot position, when said heel cleat and said forefoot cleat are engaged with the ground surface and said main sole is pivoted with respect to the ground surface such that said forefoot portion of said main sole moves laterally outward with respect to an instep side of said main sole.

11. The sole assembly of claim 10, further comprising:

a locking pin; and wherein said forefoot plate defines a locking aperture, and said forefoot support defines a retention aperture, said locking pin configured to selectively extend through said locking aperture and said retention aperture when said locking pin is in a locked position such that said forefoot support is maintained in said first forefoot position.

12. The sole assembly of claim 11, wherein said locking pin is selectively removable from said retention aperture, thereby allowing selective sliding of said forefoot support with respect to said main sole.

13. The sole assembly of claim 10, further comprising a pair of arcuate slide supports secured to said main sole and disposed beneath said forefoot portion of said main sole, said slide supports extending away from said main sole, said slide supports configured to slide laterally with respect to the ground surface when said forefoot and heel cleats are engaged with the ground surface and said main sole is pivoted about said center of rotation such that said forefoot support slides from said first forefoot position to said second forefoot position, said slide supports remaining stationary with respect to said main sole and supporting said forefoot portion of said main sole when said forefoot portion of said main sole is displaced laterally from said forefoot support.

14. The sole assembly of claim 13, wherein said arcuate slide supports define an arcuate shape having an arc center that is generally coincident with said center of rotation.

15. The sole assembly of claim 10, wherein said arc defined by said arcuate slots of said forefoot support has a first angle, and said arcuate guide slot of said heel support allows pivoting of said heel support along a second angle, said first and second angles being approximately equal.

16. The sole assembly of claim 10, wherein said center of each of said arcs are generally coincident with said center of rotation of said heel support, such that said heel support and said forefoot support may selectively pivot and slide, respectively, generally simultaneously when said heel cleat and said forefoot cleat are engaged with the ground surface and said main sole is pivoted with respect to the ground surface.

17. The sole assembly of claim 16, wherein said selective sliding of forefoot support and said selective pivoting of said heel support are independent of each other.

18. The sole assembly of claim 10, wherein said forefoot plate defines two plate apertures, said plate apertures receiving said forefoot fasteners.

19. The sole assembly of claim 10, further comprising a heel fastener securing said heel support to said heel plate, said heel fastener being selectively removable, thereby allowing selective removal of said heel support from said heel plate and reassembly of said heel support to said heel plate with said heel fastener.

* * * * *